US006880706B2

(12) United States Patent
Braconnot et al.

(10) Patent No.: US 6,880,706 B2
(45) Date of Patent: Apr. 19, 2005

(54) METHOD OF PACKAGING VARIOUS PRODUCTS IN SUSPENSION AND THE PACKAGES OBTAINED

(75) Inventors: Olivier Braconnot, St Pal en Chalencon (FR); Pierre Brun, St Pal en Chalencon (FR)

(73) Assignee: Velfor Plast, St. Pal en Chalencon (FR)

( * ) Notice: Subject to any disclaimer, the term of this patent is extended or adjusted under 35 U.S.C. 154(b) by 0 days.

(21) Appl. No.: 10/614,407

(22) Filed: Jul. 7, 2003

(65) Prior Publication Data

US 2005/0006269 A1 Jan. 13, 2005

(51) Int. Cl.[7] ..... B65D 81/05
(52) U.S. Cl. ..... 206/583; 206/363; 206/438
(58) Field of Search ..... 206/521, 583, 206/591–594, 363, 364, 365, 438

(56) References Cited

U.S. PATENT DOCUMENTS

| | | | | | |
|---|---|---|---|---|---|
| 4,241,829 | A | * | 12/1980 | Hardy | 206/591 |
| 4,491,225 | A | * | 1/1985 | Baillod | 206/583 |
| 4,750,619 | A | * | 6/1988 | Cohen et al. | 206/438 |
| 4,903,827 | A | * | 2/1990 | Phelps et al. | 206/583 |
| 5,894,932 | A | * | 4/1999 | Harding et al. | 206/583 |
| 5,967,327 | A | * | 10/1999 | Jones | 206/583 |
| 5,975,307 | A | * | 11/1999 | Harding et al. | 206/583 |
| 5,988,387 | A | * | 11/1999 | Staal et al. | 206/583 |
| 6,006,917 | A | * | 12/1999 | Loeffler | 206/583 |
| 6,223,901 | B1 | * | 5/2001 | Lofgren et al. | 206/583 |

FOREIGN PATENT DOCUMENTS

| | | |
|---|---|---|
| FR | 2 707 608 | 7/1993 |
| FR | 2775253 | 2/1998 |
| GB | 640283 | 8/1947 |
| WO | WO 89/03789 | 5/1989 |

* cited by examiner

*Primary Examiner*—Luan K. Bui
(74) *Attorney, Agent, or Firm*—Heslin Rothenberg Farley & Mesiti P.C.

(57) ABSTRACT

A method of packaging one or more products in suspension in a thermoformed shell includes producing a stand-alone subassembly incorporating a support frame, accommodating a stretch film. The film allows one or more products to be suspended, and a lid is positioned over said support frame and bears, by means of its lower surface in a point-like manner on the one or more products centered on said film. The subassembly is positioned on a thermoformed tray accommodating, on its upper face, a closure in the form of a film for purposes of sealing. The invention aims to provide packages obtained according to the method. The applications are diverse and varied and include the packaging of medical prostheses.

6 Claims, 5 Drawing Sheets

METHOD OF PACKAGING VARIOUS PRODUCTS IN SUSPENSION AND THE PACKAGES OBTAINED

Figure 1:
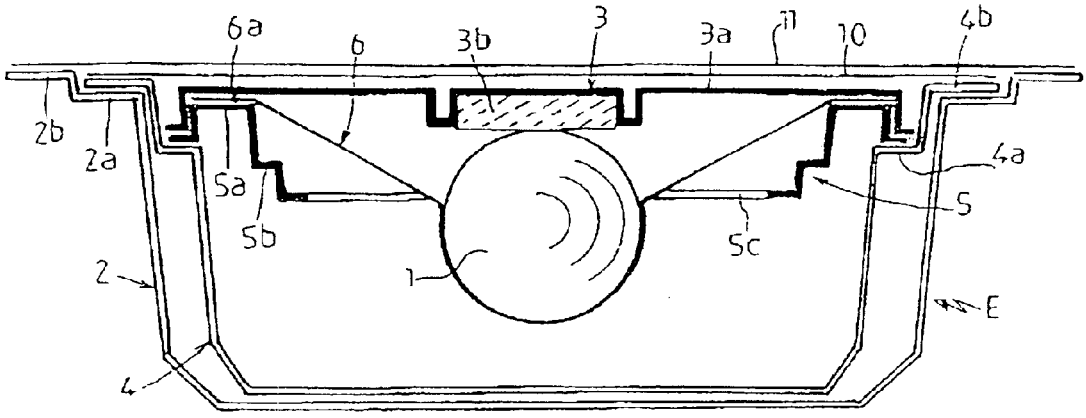

The invention relates to the technical field of packaging various products and in particular, very fragile products so that they can be transported.

More particularly, the invention relates to the technical field of packages using means of suspending one or more packaged products without said products being in contact with the bottom of the package or with any of the walls thereof.

According to the prior art, the suspension of products in a package was described in GB Patent No. 640 283. In this particular case, it involved packaging for food products of the "tomatoes, apricots" type, the products being arranged between two plastic stretch films and two half-shells able to form a one-piece assembly, by means of their peripheral circumference.

A concept of the same type is also known for the same application, through French Patent No. 2,707,608.

Another technique was proposed in French Patent No. 2,775,253, for the application of presenting and preserving food products. According to this document, a containment space is produced by covering the open part of the shell using a pretensioned stretch film, it is then physically deformed by the action of movable shaping tools having the shape of the product or products to be packaged. During the molding operation, a partial vacuum is produced in the closed volume of the shell in order to keep, by means of a vacuum, the shaped film in position. The product or products are put in place. Next, the peripheral border of the film is cut outside the adhesion region of the film to the edge of the shell.

Two half-shells are thus produced, each one with a film and one or more cavities, then they are superimposed and mutually fastened by their peripheral border. The products are therefore placed in the cavities shaped from the stretch films in a sandwich configuration.

According to the aforementioned method, the use of shaping tools, which are shaped to the profile and to the characteristics of the piece or of the product to be packaged, requires a multiplicity of this type of tooling. Specifically, shaping tools with different characteristics have to be provided depending on the varied nature of the products to be packaged and depending on the dimensions thereof.

For simultaneous packaging of several products in one and the same package, the tooling comprises several shaping tools. It is therefore necessary that the products have the same, or substantially the same, size. The products are held in symmetrical cavities formed on each of the half-shells of the package. This may result in floating packaging of said products in the cavities if the size of the product is poorly matched to the internal volume defined by each cavity made from the two half-parts of stretch film previously pressed and shaped by the shaping tools.

From this prior art, the applicant has sought a novel design of a packaging method which overcomes the aforementioned constraints and drawbacks.

A first aim, according to the invention, was to design a novel method which makes it possible to package a product in suspension while providing a firm and stable hold narrowly matched to the shape of the product to be packaged.

Another sought-after aim was to do away with the tools for shaping the cavities accommodating products.

Another aim was to design a package making it possible to suspend various products with applications as diverse as medical prostheses, mechanical parts, food products, etc.

These and other aims will clearly emerge from the rest of the description.

According to a first characteristic of the invention, the method of packaging one or more products in suspension in a thermoformed shell [lacuna] characterized in that it consists in producing a stand-alone subassembly incorporating a support frame, accommodating a stretch film, said film allowing one or more products (1) to be suspended, and a lid positioned over said support frame and bearing, by means of its lower surface, in a point-like manner on the product or products centered on said film, and in that said subassembly is positioned on a thermoformed tray accommodating, on its upper face, a closure in the form of a film for purposes of sealing.

According to another characteristic of the invention, the method of packaging one or more products in suspension in a tray in the form of a thermoformed shell [lacuna] characterized in that it implements the following phases:

- a thermoformed support frame which is open at its center is used in order to position a stretch plastic film, the film bearing on the upper peripheral border of the frame, thereby being fastened to the latter,
- said support frame is positioned on a matrix having enough depth to allow the downward deformation of the film by means of the action of an evacuating source,
- evacuation is carried out dragging the film downward with deformation by stretching,
- the product or products to be packaged are positioned on the stretch film and a vertical bearing and pressing effect is exerted by a means coming into contact with the product or products,
- all or part of the evacuating operation is stopped, allowing the partial rise of the stretch film while at the same time bearing and pressing on the product or products, allowing partial retraction of the stretch film in order to ensure said product or products are covered by the film beyond its or their widest part,
- the vertical pressing force is stopped, allowing the stretch film and the product or products to rise and additional covering of the latter, the product or products being suspended,
- the lid is positioned on the support frame, thereby bearing on the upper plane of the product or products,
- the support frame with the film and the product or products constituting the subassembly are transferred to a tray forming a thermoformed shell of the packaging and the closure film is deposited on the upper face of the tray.

These characteristics and others will clearly emerge from the rest of the description.

To set [sic] the object of the invention illustrated non-limitingly in the figures of the drawings where:

FIG. 1 is a view in cross section of a package supporting a product suspended according to the invention, the package being produced, in a particular application, for spherical prostheses.

Figure 2:
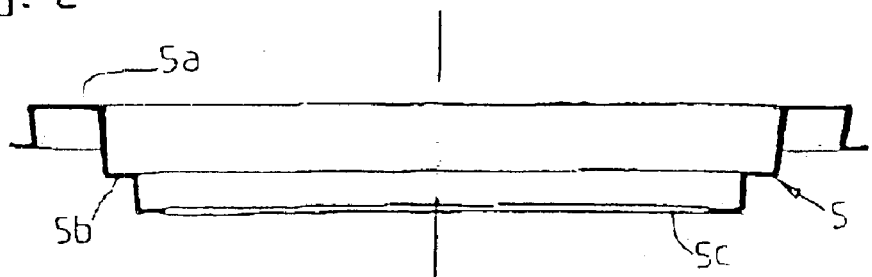
Figure 3:
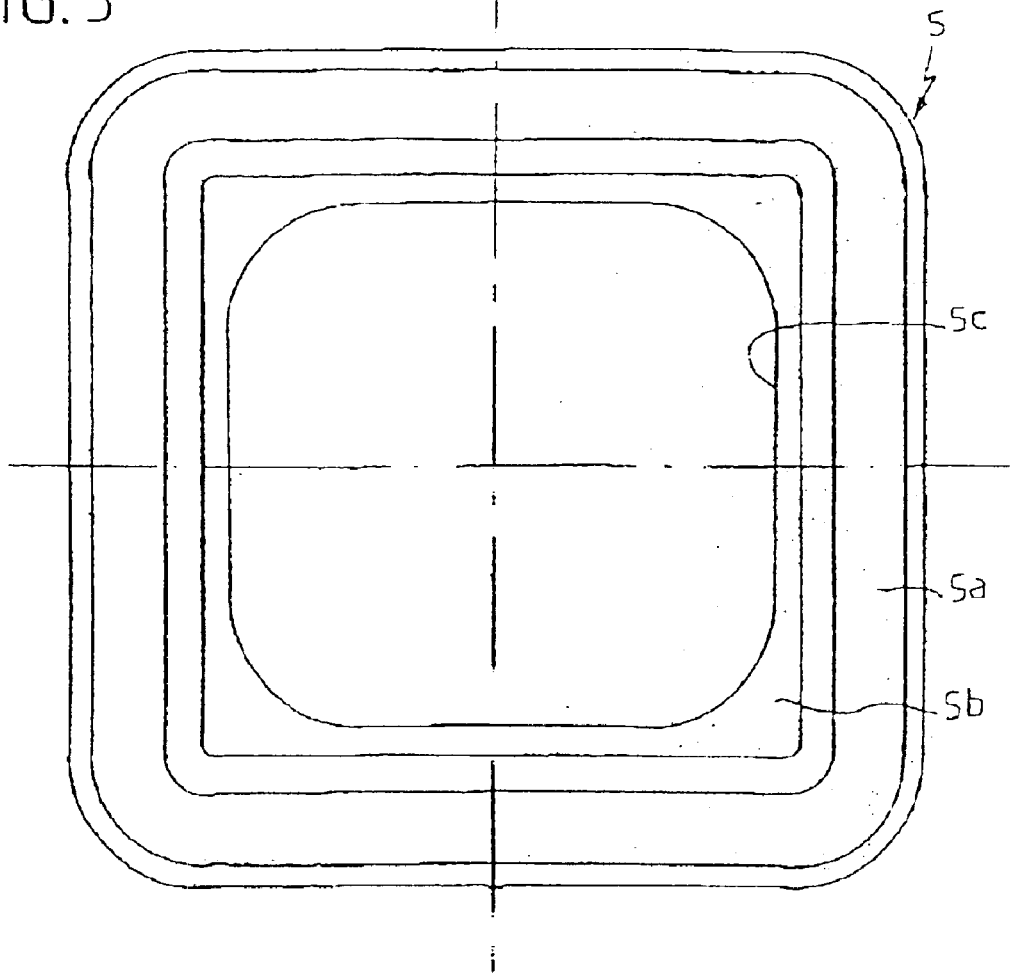
Figure 4:
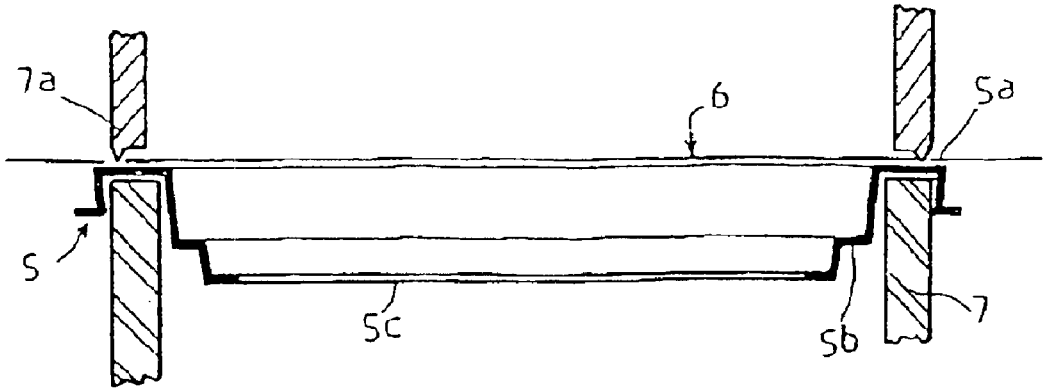
Figure 5:
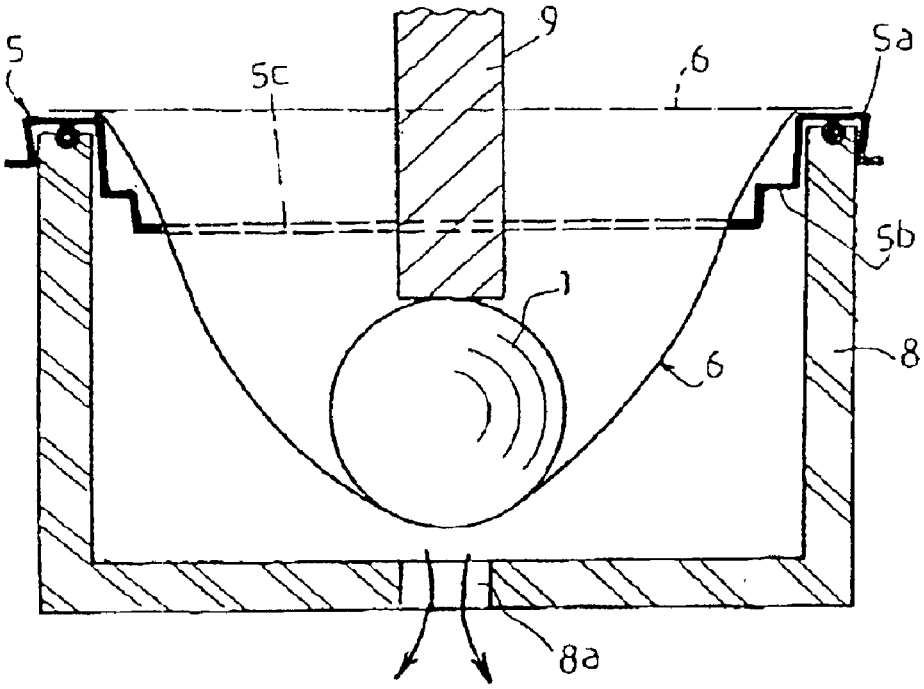
Figure 6:
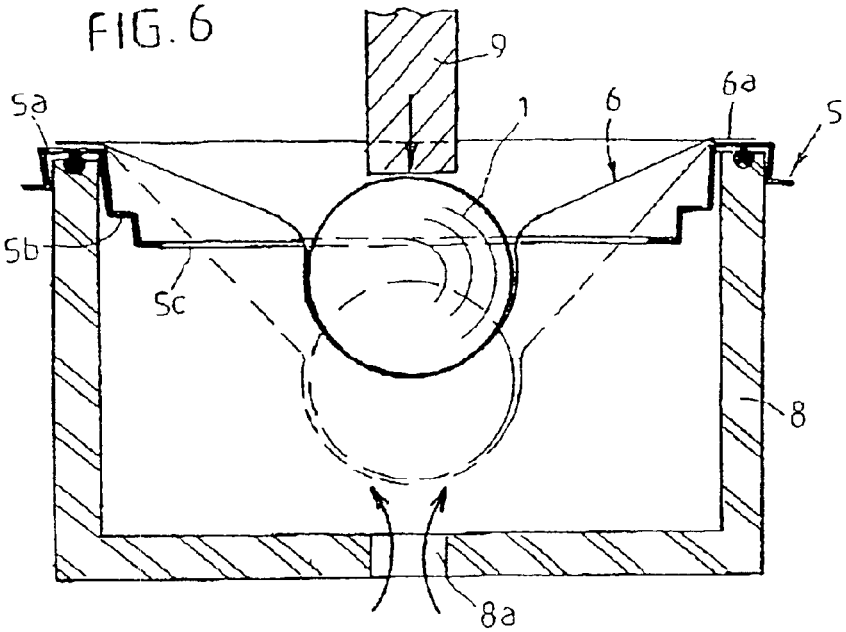
Figure 7:
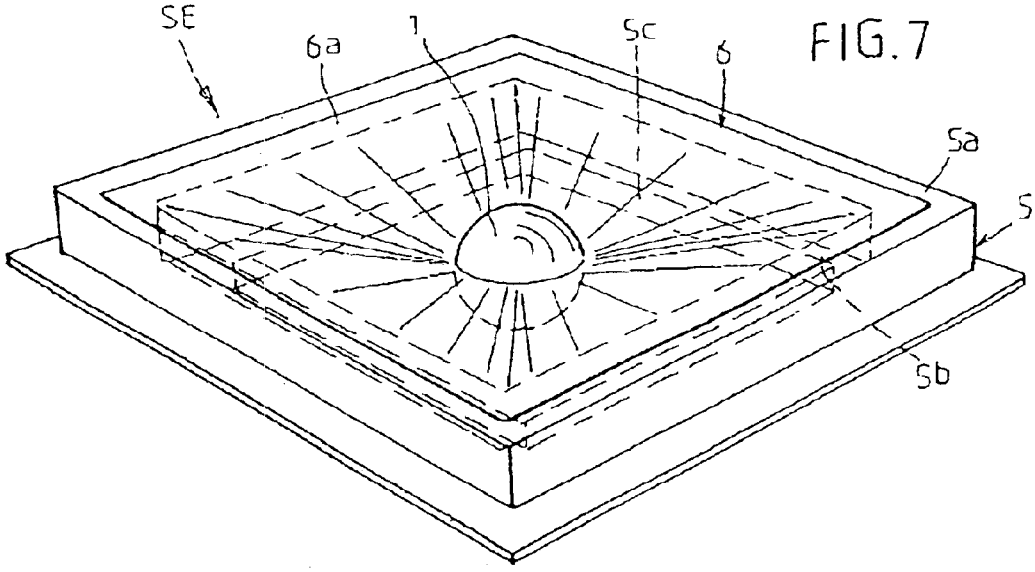
Figure 8:
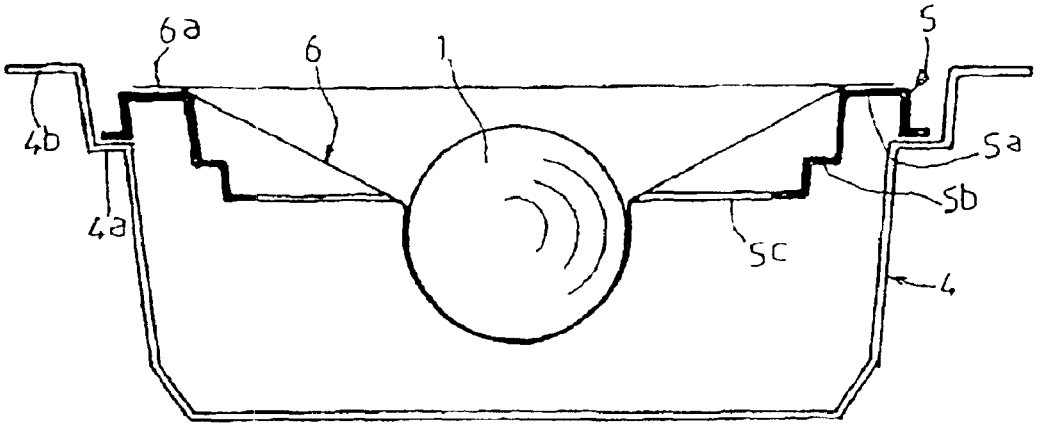
Figure 9:
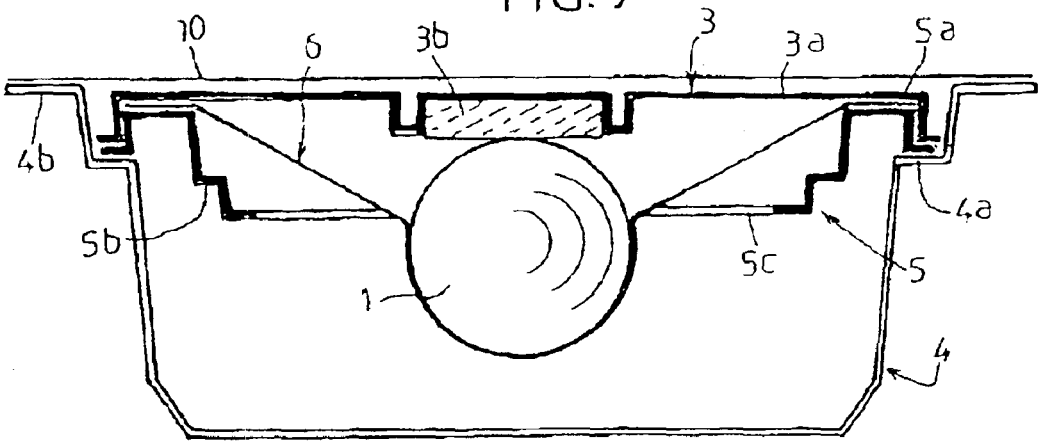

FIG. 2 is a view of a support frame needed to suspend the product to be packaged, FIG. 3 is a top view of FIG. 2, FIG. 4 is a view illustrating the support frame in position on a matrix with the horizontal positioning of a stretch film, FIG. 5 is a view according to FIG. 4, in which the stretch film was sucked downward from the matrix beforehand, then after positioning of the product to be packaged and application of pressure thereto, FIG. 6 is a view according to FIG. 5, illustrating the release of the stretch film subsequent to stopping the effect of suction under vacuum, FIG. 7 is a perspective view illustrating the support frame, after removing the matrix, FIG. 8 is a view, according to FIG. 7, after positioning of the support frame on the support frame [sic], FIG. 9 is a view according to FIG. 8, illustrating the affixing of a lid onto the thermoformed shell of the package, and subsequent film-coating.

In order to further specify the subject of the invention, it will now be described in a nonlimiting manner illustrated in the figures of the drawings.

In the rest of the description, the term "product" to be packaged will be taken in its generic sense. It is referenced overall by (1). In an advantageous exemplary application, this product or these products may be spherical prostheses. In general, the products to be packaged according to the method of the invention are fragile and must have no contact with the bottom of the package or its walls.

Initially, it is appropriate to continue with the description of the package obtained according to the invention.

Depending on the applications, the requirements of protection and safety, and also of leaktightness, the package (E) taken overall may be rearranged with one or more thermoformed trays capable of being incorporated into each other.

With reference to FIG. 1, this package is referenced overall by (E). It comprises a first thermoformed plastic shell-shaped tray (2) having, on its upper part, a flat and horizontal inner peripheral flange (2.*a*) forming a bearing region for another tray forming a thermoformed profiled shell (4) and having, in succession, two horizontal and stepped bearing regions (4.*a* and 4.*b*).

This second tray, located inside the previous one, in the exemplary application to prostheses for medical use, is capable of receiving a stand-alone subassembly (SE) comprising a support frame (5), a stretch film (6) allowing the product or products to be suspended and a lid (3) for protecting said product or products. To this end, said subassembly bears on the lower stepped part (4.*a*) of the tray (4). The stretch film (6) is made of polyurethane, polyethylene, or other materials offering the qualities and specific properties of stretching and shrinking.

The stretch film is welded by ultrasound, adhesively bonded or the like by means of its end (6.*a*) to the horizontal upper border (5.*a*) of the support frame. The lid (3) is arranged to accommodate, on its inner face (3.*a*), directly or in an attached manner, at least one insert (3.*b*) or packing capable of coming into contact, without damage, with the upper part of the product or products.

Thus the package according to the invention makes it possible, by means of said stand-alone subassembly (SE), to suspend the product or products, firmly bearing on and holding the latter preventing any floating detrimental to its or their integrity.

The packaging may thus comprise one or two trays fitted into each other thereby allowing the subassembly (SE), consisting of the support frame, the stretch film, the product or products and the lid (3), to be positioned. The flat upper face (3.*c*) of the lid is advantageously located in a plane below the plane consisting of the outer peripheral border (4.*b*) or (2.*b*) of the tray so as to allow the additional closure of the tray or trays by means of a film (10) and (11) providing better sealing.

The method of manufacturing the package enabling one or more products to be suspended is as follows.

A thermoformed frame (5) which is open at its center (5.*c*) having a flat and horizontal upper border (5.*a*) is used in order to form a bearing region. This thermoformed support frame may, depending on the applications, have one or more stepped regions (5.*b*) inside, forming bearing regions. This frame may be of rectangular or square configuration or the like.

In a first phase of the method, the frame is closed by positioning the latter on a matrix (7), engaging it around the peripheral border (5.*a*) and inside the latter. The stretch film (6), for example made of polyurethane or polyethylene, is attached above said frame (FIG. 4) and, using a cutting and melting means (7.*a*), it is sealed on to said upper border of the support frame. The frame produced in this way with its film is put in place on another matrix (8) having enough depth to allow the downward deformation of the stretch film. This matrix accommodates said support frame (5) in its upper part by bearing. This matrix has one or more small openings (8.*a*) making it possible to carry out, using a suitable means, suction under vacuum. Evacuation is then carried out, which drags the film (6) downward with a deformation by stretching.

Then, according to FIG. 5, the product (1) is positioned in the center of the stretch film. A tool or pressing means (9) placed in a vertical plane bears on the product, thereby completing its holding.

The following phase, shown in FIG. 6, shows the omitting or release of the vacuum effect thus produced in the matrix (8), while at the same time suitably bearing and pressing on the product by means of the tool (9). The phenomenon of the product (1) rising due to the effect of partial retraction of the stretch film then takes place. The latter then partially surrounds the product beyond its half part. For a sphere, as shown in FIG. 6, the stretch film goes beyond, in its contact with the product, the corresponding half part thereby retaining and partially trapping the product in question. In other words, the film surrounds the product and clasps it tightly beyond its widest part.

The following phase consists in completely removing the vertical pressure on the product, which, as a result, then rises slightly toward the upper part of the support frame, thereby increasing the clasping effect. The product is thus in suspension from the support frame (5).

The following phase consists in positioning the lid (3) on the support frame. The lid according to the invention is placed on its lower face, directly or in an attached manner, with a projecting region (3.*c*) able to make contact and bear on the upper plane of the product. More specifically, the lid has an inner flange accommodating a bearing packing (3.*b*), made of foam or another material, capable of not scratching or damaging the product in any way.

The following phase consists in positioning the subassembly (SE) equipped in this way on the tray forming a thermoformed shell of the package (FIG. 8).

Thus a stand-alone subassembly (SE) comprising support frame, film, product, lid (FIG. 7) is created.

Next, the closure film (10) is positioned on the upper face of the tray.

If, depending on the application, there are two trays incorporated one in the other in order to strengthen the protection and safety of the products, each tray receives a closure and sealing film (10–11).

Thus, according to the invention, the aforementioned method and the product obtained make it possible to obtain better holding and clasping of the products to be packaged, and this whatever their shape, volume and dimensions, while not requiring any particular tool, as is the case for the prior art, and whatever the applications.

Depending on the type of products to be packaged, and on its fragility criteria, the outer package may have one or two shells fitting inside each other, as shown in FIG. 1 or a single shell, as shown in FIGS. 8 and 9.

The package or packages of the aforementioned type may allow the simultaneous packaging of one or more products.

The advantages clearly emerge from the invention. The novel concept of the method, which is applicable whatever the shape of the product or products to be packaged, is emphasized.

What is claimed is:

1. Packaging for a product suspended on a stretch film, said film being secured to a peripheral edge of a shell-shaped tray of the packaging, comprising:

at least one tray in the form of a thermoformed shell having a flat and horizontal inner peripheral flange, internally allowing positioning of a stand-alone subassembly including a profiled support frame which is open in its center on which a sheet of stretch and shrink film is positioned, fastened to said support frame and allowing one or more products to be suspended on said sheet, said sheet of stretch and shrink film surrounding and contacting the one or more products beyond a widest region of said one or more products, said subassembly including a lid having a packing placed on its lower face for bearing, without damage, on an upper part of the one or more products.

2. Packaging according to claim 1, comprising several shell-shaped trays shaped to match stepped bearing regions and to be positioned one in the other depending on level of fragility of the one or more products contained in said packaging, and wherein a lower tray accommodates the subassembly for suspending the one or more products.

3. Packaging according to claim 2, wherein an upper face of the trays accommodates a closure and sealing film, and wherein an upper face of the lid is in a plane below the upper plane of said trays.

4. Packaging according to any one of claims 1–3, wherein the stretch film is made of polyurethane, or polyethylene.

5. Packaging according to any one of claims 1–3, wherein said one or more products comprise medical prostheses.

6. Packaging according to claim 1, wherein said sheet of stretch and shrink film surrounds and contacts the one or more products beyond a widest region of said one or more products due to partial retraction of the sheet.

* * * * *